United States Patent [19]

Mente

[11] Patent Number: 4,637,104

[45] Date of Patent: Jan. 20, 1987

[54] APPARATUS FOR SPREADING OUT A PLURALITY OF FILAMENTS

[75] Inventor: Kürt Mente, Hanover, Fed. Rep. of Germany

[73] Assignee: J. H. Benecke GmbH, Hanover, Fed. Rep. of Germany

[21] Appl. No.: 826,838

[22] Filed: Feb. 6, 1986

[30] Foreign Application Priority Data

Feb. 11, 1985 [DE] Fed. Rep. of Germany .. 3504588[U]

[51] Int. Cl.[4] ..... D01D 11/02

[52] U.S. Cl. ..... 28/283; 19/65 T; 19/296; 19/304

[58] Field of Search ..... 19/65 T, 296, 304, 305, 19/66 T, 306, 307, 308, 288; 28/283; 239/419.5

[56] References Cited

U.S. PATENT DOCUMENTS

| | | | |
|---|---|---|---|
| 3,364,538 | 1/1968 | Murphy | 19/304 X |
| 3,713,590 | 1/1973 | Dorschner et al. | 28/283 |
| 3,766,606 | 10/1973 | Piper | 28/283 |

FOREIGN PATENT DOCUMENTS

| | | | |
|---|---|---|---|
| 1182674 | 3/1970 | United Kingdom | 19/296 |

*Primary Examiner*—Louis K. Rimrodt

*Attorney, Agent, or Firm*—Cushman, Darby & Cushman

[57] ABSTRACT

In a baffle tray for a fiber distributor, the tray has opposite curved walls, the lower edges of which of their midpoints are each provided with an arcuate recess to aid in uniform formation of a fleece.

5 Claims, 4 Drawing Figures

APPARATUS FOR SPREADING OUT A PLURALITY OF FILAMENTS

DESCRIPTION OF THE INVENTION

An apparatus for distributing fibers in the production of spun fleece in accordance with the general concept is already known from DE-PS No. 24 21 401 and U.S. Pat. No. 3,713,590, the disclosure of which is incorporated by reference herein.

It has been shown that with such units also known as changing devices certain irregularities appear in the production of fleece which appear as reduced fluff formation of the produced fleece. Supposedly, this is based on the fact that the fibers are deposited too densely in the areas affected when the corresponding dead points are reached during the oscillation of the flow baffles. This can also not be eliminated by increasing the frequency of the back and forth motion.

This present invention has the objective of creating a functionally reliable production apparatus that remains easy to service and which allows for the production of spun fiber fleece of the highest possible degrees of regularity.

In order to solve this task, an apparatus of the aforementioned type is proposed in which an arc-shaped recess is provided on both sides at the lower edge of the oscillating flow baffles (coanda trays).

Other preferred embodiments are contained in the subclaims.

Surprisingly, it was shown that a completely uniform spun fiber fleece can be produced with an arc-shaped recess in the central area of the edges of each flow baffle (coanda trays). Even though the cause for the almost complete uniformity of the produced spun fiber fleece achieved in this way is not yet precisely known, it can be assumed that a uniform distribution occurs because the deflector points at the lower edge of the coanda tray are located at different heights so that there is slightly less deflection in the internal region of the arc-shaped groove and larger deflection in the external region or rim area of the coanda trays, resulting in a uniform production of the fibers with consideration given to the entire flow and production ratios.

BRIEF DESCRIPTION OF THE DRAWINGS

Below, the invention is described with the aid of illustrations; they show.

DETAILED DESCRIPTION OF THE PREFERRED EMBODIMENT

The fibers, which are initially entrained directed after the spinning process in a known way by means of a flow medium, are guided through an expander nozzle, 5 or 5', to the flow baffles or coanda trays, 1 and 2 or 1' and 2', and are deflected alternatingly and periodically in opposite directions, due to reciprocations or oscillations, perpendicular to the original course of the fibers. This occurs by the fact that the two coanda trays are moved back and forth in the direction of arrows P and P' in such a way that the threads make contact in rapid succession and alternatingly with one of the two flow baffles. The frequency of the motion back and forth is from 10 to 60 and preferably from 25 to 50 $s^{-1}$ in one region. The fibers are deposited on a support moving in direction B.

The individual coanda trays, 1, 2 or 1', 2', are rigidly connected by other baffles, 3 and 4, as is shown in diagram 1 and 4. These other baffles, 3 and 4, are shaped convexly in the direction of the expander nozzles or can be a simple tube which is engaged by the vibratory drive for the purpose of oscillation or reciprocation.

At each lower edge of the coanda trays, 1, 2 or 1', 2', there are arc-shaped grooves, 6 and 7. The depth at the vertex of the arc-shaped grooves, 6, 7, is about 4 to 6 mm with a base of about 2.5 to 3 cm with reference to a coanda tray that is about 6 cm wide and about 3 cm high.

Figure 1:
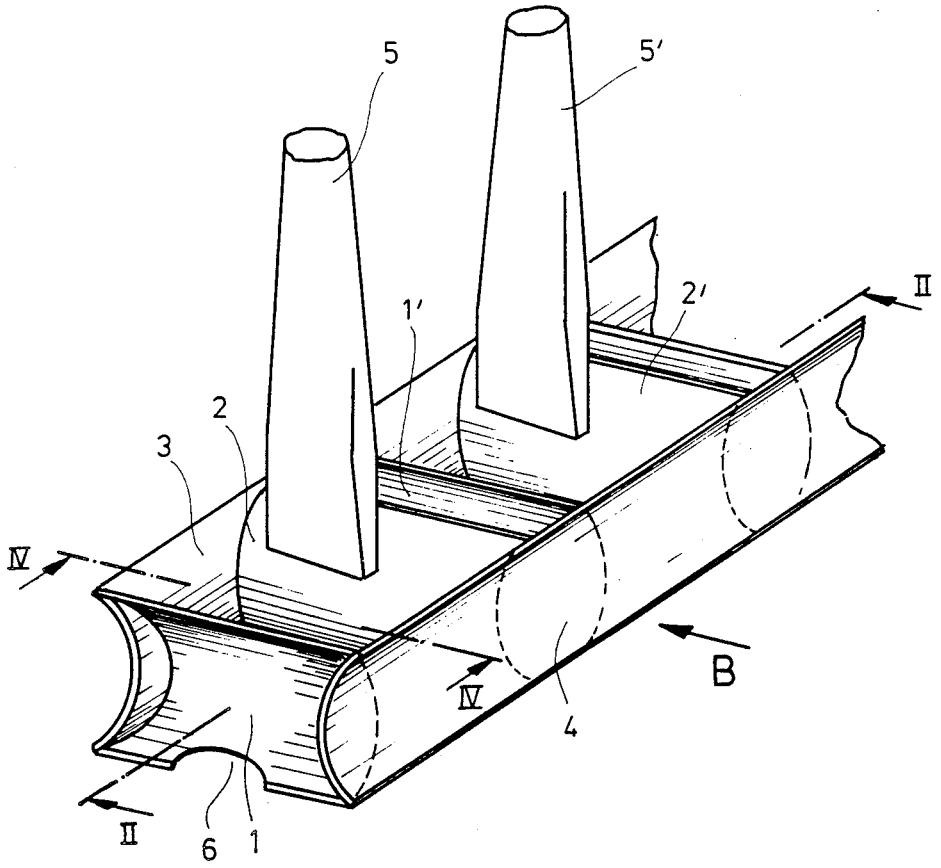
FIG. 1: a side view of a portion of a deflection unit.
Figure 3:
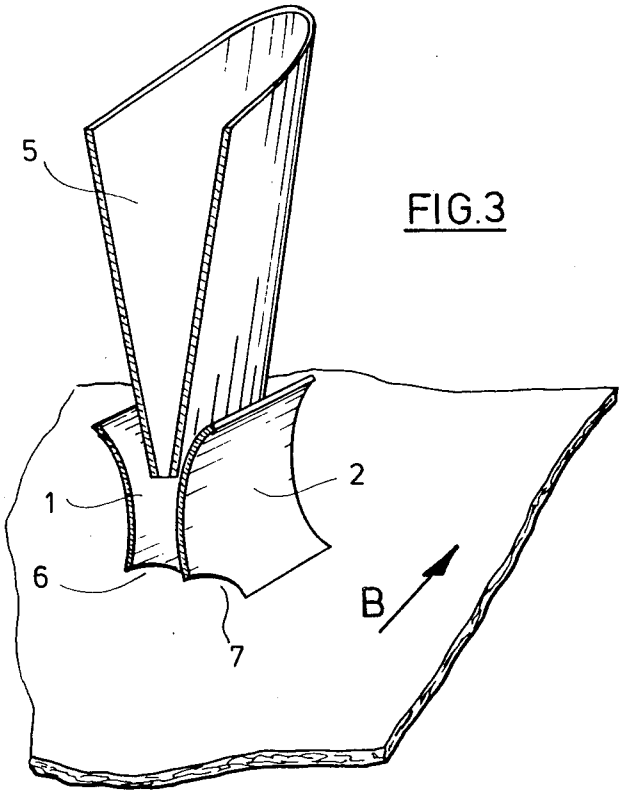
FIG. 3: a partial side-view of a cross-section of the apparatus similar to diagram 2.

As is shown in FIGS. 1 and 3, the slit-like expander nozzles are positioned in such a way that the longer dimension of the nozzle opening is located in the direction of vibratory motion of the trays 1, 2 and aimed below the deflection unit.

Figure 2:
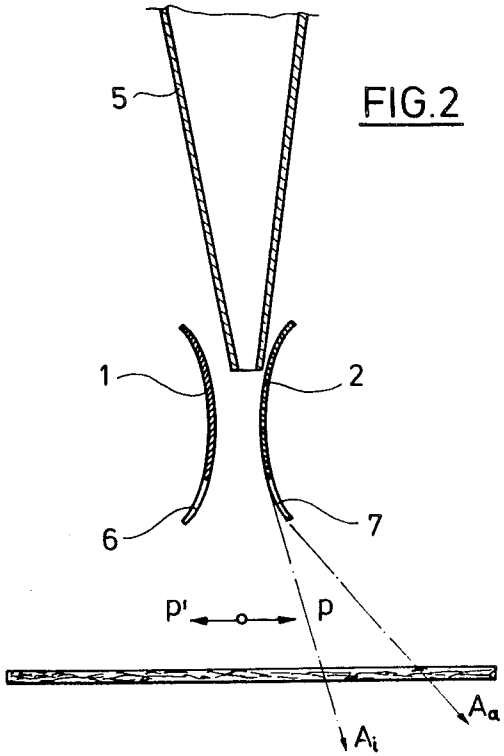
FIG. 2: a vertical cross-section through an expander nozzle with flow baffles along line II—II.
Figure 4:
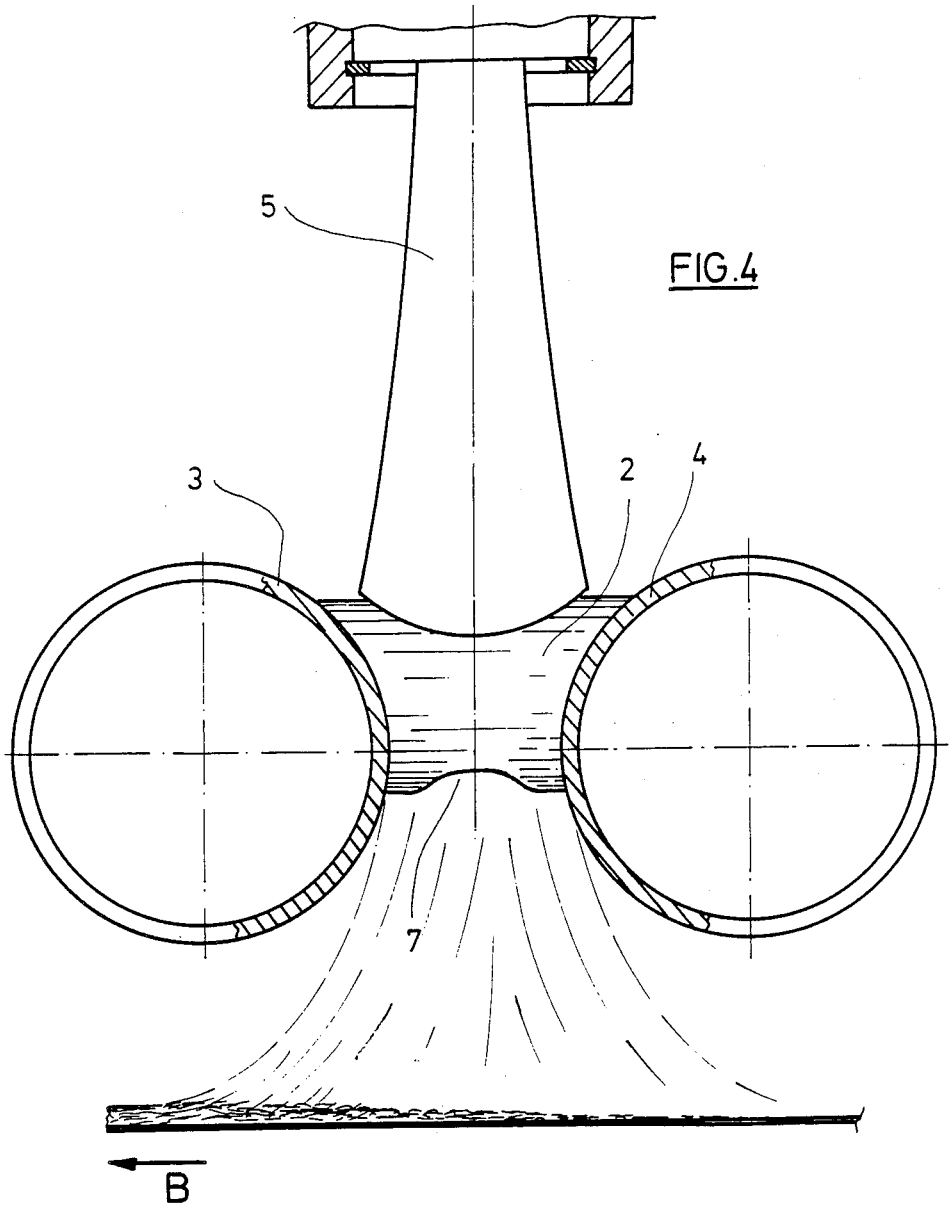
FIG. 4: a side-view of the expander nozzle with a coanda tray along line IV—IV.

FIG. 2 shows clearly that the deflection of the path of the fibers in the vertex of the recess is very much smaller (arrow $A_i$) than the deflection at the lower edge of the coanda tray (arrow $A_a$).

Of course, it is possible to design and dimension the groove differently in the event that there is a slant to the formation of fluff in the produced spun thread fleece due to flow or output proportions in certain areas.

The use of the apparatus described above leads to endlessly spun thread fleece of complete uniformity which up to now could not be achieved with known apparatus.

Furthermore, contrary to known procedures, as for example the 'DOCAN' method with one dimensional expansion, the two additional baffles set at an angle of 90° to the flow baffles allow for two dimensional expansion with complete uniformity of the product.

What is claimed is:

1. An apparatus for distributing fiber from a source by pneumatic feed means, including a nozzle having an outlet and baffle means disposed adjacent to said nozzle, the improvement comprising, said baffle means including walls disposed on opposite sides of said outlet, said walls being rigidly connected so as to be movable together along a path in reciprocating motion, each said wall having an edge remote from said outlet with each said edge having a midpoint with a recess being formed in each said edge about each said midpoint.

2. The invention as claimed in claim 1 wherein each said recess is arcuately shaped and having a vertex located in the middle of the associated wall.

3. The invention as claimed in claim 2 wherein the width of each recess is from 20 to 25 mm and the depth of each recess is approximately 4 to 8 mm, and each associated wall has a width of approximately 6 cm and a height of approximately 3 cm.

4. The invention as claimed in claim 1 wherein said walls are each connected by baffle walls to form an enclosed space serving as an expander for fibers ejected by a said nozzle.

5. The invention as claimed in claim 1 wherein a plurality of nozzles are provided each having an outlet and a plurality of said baffle means are provided with each being associated with a nozzle, said baffle means all being connected to a vibratory drive for imparting reciprocatory motion to said baffle means.

* * * * *